US005377905A

United States Patent [19]

Sigrist

[11] Patent Number: 5,377,905

[45] Date of Patent: Jan. 3, 1995

[54] PACKAGING BOX, BLANK THEREFOR, AND METHOD OF ASSEMBLY

[75] Inventor: Albert Sigrist, Colombier, Switzerland

[73] Assignee: Philip Morris Incorporated, New York, N.Y.

[21] Appl. No.: 104,574

[22] Filed: Aug. 11, 1993

[30] Foreign Application Priority Data

Aug. 28, 1992 [EP] European Pat. Off. ..... 92810661.6

[51] Int. Cl.[6] ..... B65D 5/54

[52] U.S. Cl. ..... 229/231; 206/264; 229/930

[58] Field of Search ..... 229/215, 219, 231, 930, 229/931; 206/264

[56] References Cited

U.S. PATENT DOCUMENTS

| | | | |
|---|---|---|---|
| 416,115 | 11/1889 | Mayall | 229/930 |
| 1,541,143 | 6/1925 | Heile | 229/231 |
| 1,739,529 | 12/1929 | Skinner | 229/231 |
| 1,907,067 | 5/1933 | Hartmann | 229/231 |
| 2,508,193 | 5/1950 | Ringler | 229/231 |
| 2,881,967 | 4/1959 | Ringler | 229/231 |
| 3,018,031 | 1/1962 | Ahlbor et al. | 229/231 |
| 3,037,683 | 6/1962 | Sherrill | 206/264 |
| 3,048,324 | 8/1962 | Anderson | 229/51 |
| 3,207,417 | 9/1965 | Hennessy et al. | 229/51 |
| 3,765,593 | 10/1973 | D'Allessio | 229/231 |
| 3,897,900 | 8/1975 | Gorski et al. | 206/264 |
| 4,513,863 | 4/1985 | Schillinger | 229/231 |
| 4,890,440 | 1/1990 | Romagnoli | 53/456 |

FOREIGN PATENT DOCUMENTS

| | | | |
|---|---|---|---|
| 697686 | 11/1964 | Canada | 229/231 |
| 670668 | 9/1968 | Canada . | |
| 713675 | 8/1931 | France . | |
| 1207892 | 9/1959 | France . | |
| 1277662 | 10/1961 | France . | |
| 2130640 | 11/1972 | France . | |
| 1255030 | 11/1967 | Germany . | |
| 2207449 | 8/1973 | Germany . | |
| 929825 | 6/1963 | United Kingdom . | |
| 2031386 | 4/1980 | United Kingdom . | |
| 2207881 | 2/1989 | United Kingdom . | |

OTHER PUBLICATIONS

The Wiley Encyclopedia of Packaging Technology, John Wiley & Sons, pp. 150, 151 (1986).

*Primary Examiner*—Gary E. Elkins

*Attorney, Agent, or Firm*—Kevin B. Osborne; James E. Schardt; Charles E. B. Glenn

[57] ABSTRACT

The packaging box is made from a one-piece blank and comprises a receptacle portion and a lid portion bounded by perforation lines made in the receptacle portion. A closure flap is fixed to the lid portion. The box is opened for the first time by acting upon this flap to separate the perforated lid portion from the rest of the receptacle portion. When the box is reclosed, the lid portion is kept shut by inserting the closure flap into the box. The packaging box is fluid-tight after manufacture so that no additional wrapping sheet is needed. The blank may be made of thin cardboard and may be provided with a self-sealing coating.

37 Claims, 4 Drawing Sheets

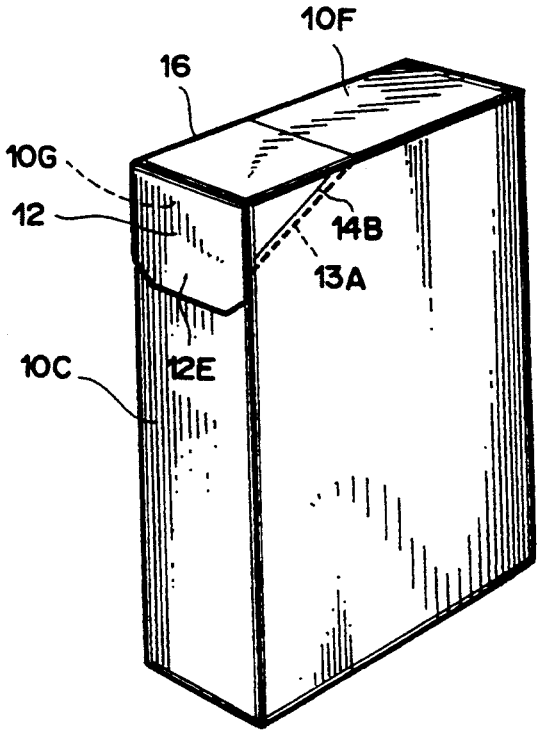
Fig. 4
Fig. 5
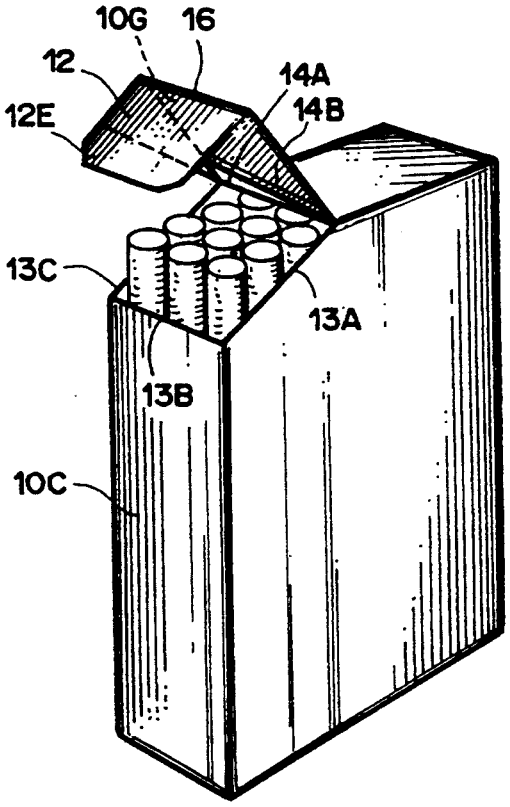
Fig. 6
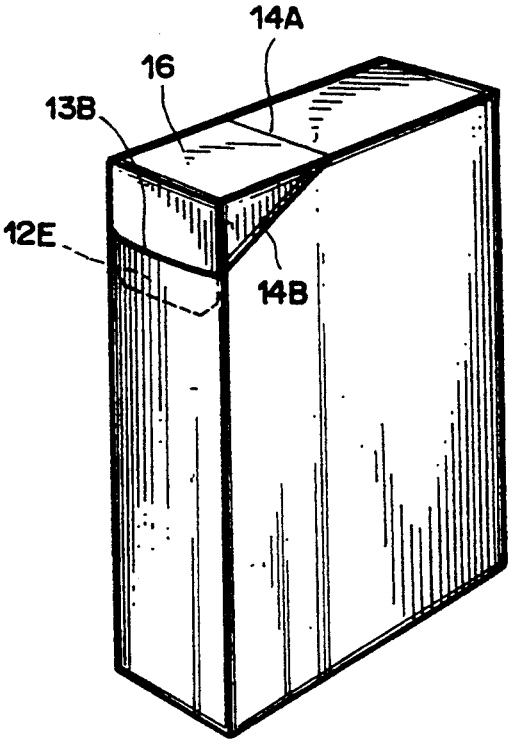

PACKAGING BOX, BLANK THEREFOR, AND METHOD OF ASSEMBLY

BACKGROUND OF THE INVENTION

This invention relates to packaging materials, and more particularly to a packaging box, especially for products of the tobacco industry. This invention also relates to a blank for producing such a packaging box, of the type having a plurality of surface portions joined to one another by folding ribs, where the surface portions are intended subsequently to form faces or tongues of the package. The blank is formed in one piece. This invention further relates to a method of erecting such a blank.

The packaging industry has developed a great number of blanks intended, after folding and erection, to form the packaging of specific products, such as products of the tobacco industry, and in particular cigarettes. In this connection, a distinction is made between two kinds of cigarette packaging—viz., the so-called "soft pack," composed of one or more thin packaging sheets wrapped around a bundle of cigarettes, and the "box," produced from a thin cardboard blank and possessing a certain rigidity. It is to the latter type of packaging that the present invention relates. Cigarette packaging of this kind generally includes a box portion in which the cigarettes are contained and a lid portion hinged to the box portion. As a rule, the cigarettes are first wrapped in a composite sheet comprising an aluminized layer, then inserted in the box, which, after the lid is closed, is subsequently covered with a thin protective sheet of polypropylene or cellophane in order to keep the pack substantially hermetically sealed during storage.

Such packs, and blanks for forming them, are well known and are described, for example, in French Patent No. 1,207,982. The way in which the closure tongue of the pack shown in that patent is made leads to several drawbacks at the time of its manufacture and use. First of all, the pack includes a semicircular tongue 27, the making of which necessitates complicated tooling. After a closure tongue 8 is folded back inside the pack, and semicircular tongue 27 is glued no one or the other of the portions 34 or 36, two slits remain on the top edge of the face 3, at the ends of semicircular tongue 27, which prevents the finished pack from being sealed without an additional wrapper. Hence the pack must be supplemented by an additional sheet which covers the pack and is sealed in order that the pack of cigarettes may be moisture-proof during storage. This is important so that the tobacco will not dry out or lose its aroma and so that no foreign odors can penetrate into the pack. This additional wrapping requires several supplementary operations during preparation of the pack and furthermore generates added trash to be disposed of. Moreover, the fact that closure tongue 8 is disposed within the pack is a drawback insofar as it may easily be damaged when the pack is opened for the first time, when the pre-cut 21 is cut completely. Furthermore, since the closure tongue is inside the pack, it is inaccessible for opening the pack. There is no means of easily grasping the lid portion to be opened.

Each of the boxes disclosed in U.S. Pat. No. 4,890,440 and British Patent No. 2 031 386 requires a blank made up of two separate parts which have to be assembled during manufacture, thus complicating this operation and increasing the cost of the finished packaging.

The package described in U.S. Pat. No. 3,048,324 comprises a portion 53 which can be torn away, thus allowing the cover to be opened. A drawback of this packaging, according to the two embodiments described, is that it is made up of two superposed layers, thus increasing the use of raw material an its manufacture, hence the cost of the finished packaging. In Canadian Patent No. 670,668 and German (Fed. Rep.) Patent No. 22 07 449, the cover part is composed solely of a portion of the top surface of the packaging, which makes it difficult to reach the cigarettes in the pack.

SUMMARY OF THE INVENTION

It is an object of this invention to provide an improved packaging box, especially for products of the tobacco industry but usable for other purposes as well, which can be assembled in one piece in order to form a box comprising a receptacle portion, a lid portion which opens wide in order to facilitate access to the contents, and closing means so that the packaging box can be reclosed.

Another object of the invention is to provide a packaging box which can be made of an easily recyclable material, but is fluid-tight for storage without additional wrapper sheet.

A further object of this invention is to provide a packaging box made from a composite sheet or a sheet made of or covered with a self-sealing material in order to improve its fluid-tightness and to eliminate the operation of gluing the blank.

Still another object of the invention is to provide a packaging box which may be used a number of times without excessive deformation of its parts.

To this end, the packaging box according to the present invention is made from a one-piece blank. The packaging box has a closure tongue adjoining a portion forming the top face of the box, and a perforated portion composed of a top portion of a first side face and of two top side portions of a second and of a third side face of the box, the second and the third side face each being adjacent to the first side face. The closure tongue is partially fixed to the perforated portion. The box is opened by grasping a free end of the closure tongue, causing the tongue to pivot about a fold line which is disposed transversely on a top face of the box and which joins the two ends of two perforation lines provided on the second and third side faces and connected to the top face, in such a way as to separate the perforated portion of the box.

In the blank for producing such a packaging box, a closure tongue joined by a fold line to a surface portion intended to form the top face of the package is cut out of the blank. Three perforation lines are disposed on three surface portions. The first perforation line is disposed across a top part of the surface portion intended to form a first side face of the package closest to the closure tongue. The other two perforation lines are disposed symmetrically, each on a surface portion intended to form a second side face and a third side face, respectively, of the package. The second side face and the third side face, respectively, are each adjacent to the first side face. One end of each of the other two perforation lines is connected to a respective end of the first perforation line. The other end of each of the two perforation lines is situated on a folding rib defining the top edges of the surface portions defining the second side face and the third side face, respectively, of the package. The length of the closure tongue is greater than the distance separating the first perforation line from the top edge of the first side face on which the first perforation line is disposed. A fixing zone is intended for assembling the surface portion separating the first perforation line from the top edge of the first side face and the surface portion of the closure tongue which will be superimposed thereon.

In one embodiment of the method according to the present invention for erecting such a blank, the surface portion of the blank attached to the closure tongue is turned down after the surface portion facing it, as well as the top side tongue, have been turned down, thus forming the top face of the packaging box. The closure tongue is then turned down against the top part of the first side wall comprising the first perforation line. The top face of the packaging box, as well as the portion of the closure tongue close to the fold line, are fixed by gluing to the surface portions which they cover, the end of the closure tongue being kept free of glue.

BRIEF DESCRIPTION OF THE DRAWINGS

The above and other objects and advantages of the invention will be apparent from the following detailed description, taken in conjunction with the accompanying drawings, in which like reference characters refer to like parts throughout, and in which:

FIG. 4 is a perspective view of a finished pack of cigarettes before being opened for the first time;

FIG. 5 is a perspective view of the cigarette pack of FIG. 4 when opened; and FIG. 6 is a perspective view of the cigarette pack of FIGS. 4 and 5 reclosed after opening.

DETAILED DESCRIPTION OF THE INVENTION

Figure 1A:
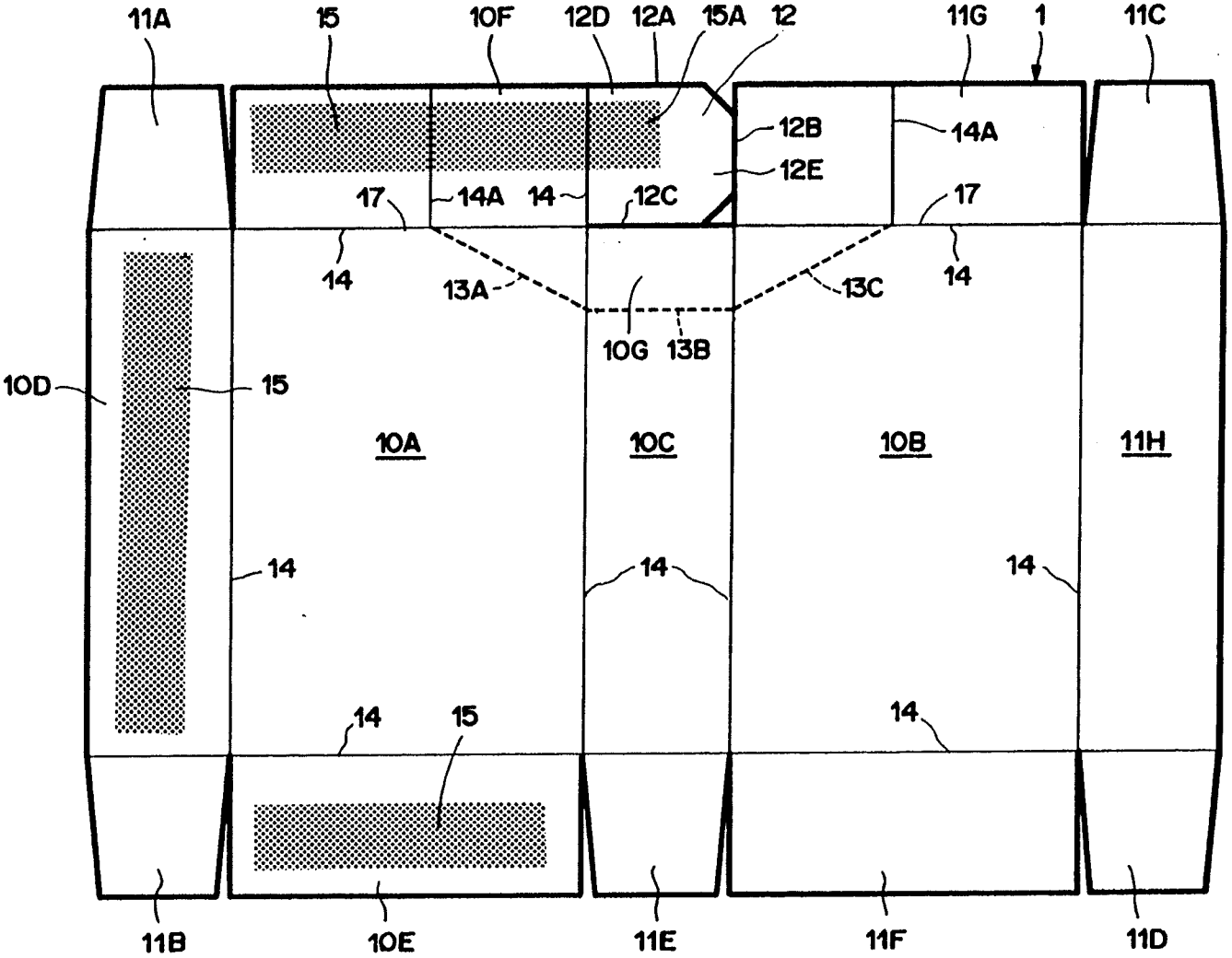
FIG. 1A is a top plan view of one side of a blank intended for a pack of cigarettes in a first embodiment of the invention.

A blank 1 for a cigarette box, the back of which is shown in FIG. 1A, is cut out of a strip or a sheet, preferably of thin cardboard or any other suitable material, which preferably is recyclable. The front of blank 1, i.e., the face not shown, is preferably imprinted with a pattern, such as the trademark or the outer design of the pack of cigarettes.

In a known manner, blank 1 includes a plurality of portions which, after folding, will form the walls of the box, such as front wall 10A, rear wall 10B, side walls 10C and 10D, bottom 10E, and top 10F, as well as joining flaps 11A–11H and closure flap 12. It is not absolutely necessary for both members of each pair of joining flaps 11A, 11B, and 11C, 11D, to be provided on blank 1; their presence merely makes blank 1 symmetrical, allowing it to be cut out with straight blades, whereas without all of these flaps rotary blades would have to be used to produce blank 1. Blank 1 is cut out along the thick lines of FIG. 1A, including in particular the three main edges 12A, 12B, and 12C of closure flap 12. Three perforation lines 13A, 13B, and 13C are also made, preferably simultaneous with or subsequent to the cutting out of blank 1 as a whole. Perforation lines 13A, 13B, end 13C are preferably made by cutting part way through blank 1 such that a thin portion of the thickness of blank 1 remains in each of the perforations, so that the parts of the walls adjoining these perforation lines remain interconnected and define a tear line for an upper side corner of the pack of cigarettes.

Fold lines 14 and 14A are made at the time of cutting of the blank or later. As used herein, a fold line is any line about which a portion of the blank can be folded. If the material of the blank is relatively thick, the fold lines are made by scoring blank 1 along lines 14, 14A with an instrument that leaves a groove on one side and a rib on the other side. Preferably, the rib is on the side that is inside the pack when pack is erected. Any fold line including a rib will be designated herein as fold line or rib 14A.

If the material of which blank 1 is made is sufficiently thin or otherwise flexible, the fold lines can simply be lines along which it is intended that the blank will fold, either with or without any marking made on blank 1, and such a fold line will be designated as fold line 14. In such a case, for example, it is not necessary to form respective fold ribs 14A in each of top panel 10F and flap panel 11G, leaving only a fold line 14 connecting the upper extremities of perforation lines 13A, 13C when blank 1 is erected into a box. Adhesive zones 15 are preferably provided at suitable locations on wall 10D, bottom 10E, and top 10F, either on the back of blank 1, as shown in the drawing, or on corresponding parts of the front of blank 1. It will be noted that closure flap 12 also preferably includes an adhesive zone 15A on a part 12D thereof close to the side of flap 12 directly attached to top 10F, whereas its cut end 12E is preferably free of adhesive.

Although the general method used for fabrication of blank 1 is known in the art, certain steps should be taken in making closure flap 12 and perforation lines 13A–13C in order to make blank 1 in accordance with the present invention. After erection of a box from blank 1, the surface portion of blank 1 bounded by the two fold ribs 14A, as well as perforation lines 13A, 13B, and 13C, will preferably form the lid of the box (see FIGS. 4–6). The dimensions of this portion should therefore preferably be selected so that the opening is large enough for its intended purpose. The proportions indicated below are the preferred dimensions for a pack of cigarettes, to allow adequate access to the cigarettes through the opening, but they may have to be adjusted for the packaging of some other product.

Perforation line 13B is preferably made transversely on an upper portion of side wall 10C. The distance between cut line 12C and perforation line 13, defining portion 10G of wall 10C, varies according to the height of the pack, and may represent about 10–20% of that height. The two perforation lines 13A and 13C are preferably disposed symmetrically on an upper side portion of front wall 10A and of rear wall 10B, respectively. Each of these perforation lines preferably has one end connected to perforation line 13B and goes off at an oblique angle to join that one of fold lines 14 forming the top edges 17 of front wall 10A and rear wall 10B. The position at which each of perforation lines 13A, 13C joins that one of fold lines 14 is variable, depending upon the length of top edges 17, but is preferably about 30–50% along that length. Moreover, the length of closure flap 12 from top 10F to edge 12E is preferably greater than the distance between cut line 12C and perforation line 13B; and part 12D of flap 12, comprising adhesive zone 15A, preferably corresponds approximately to this distance.

Figure 1B:
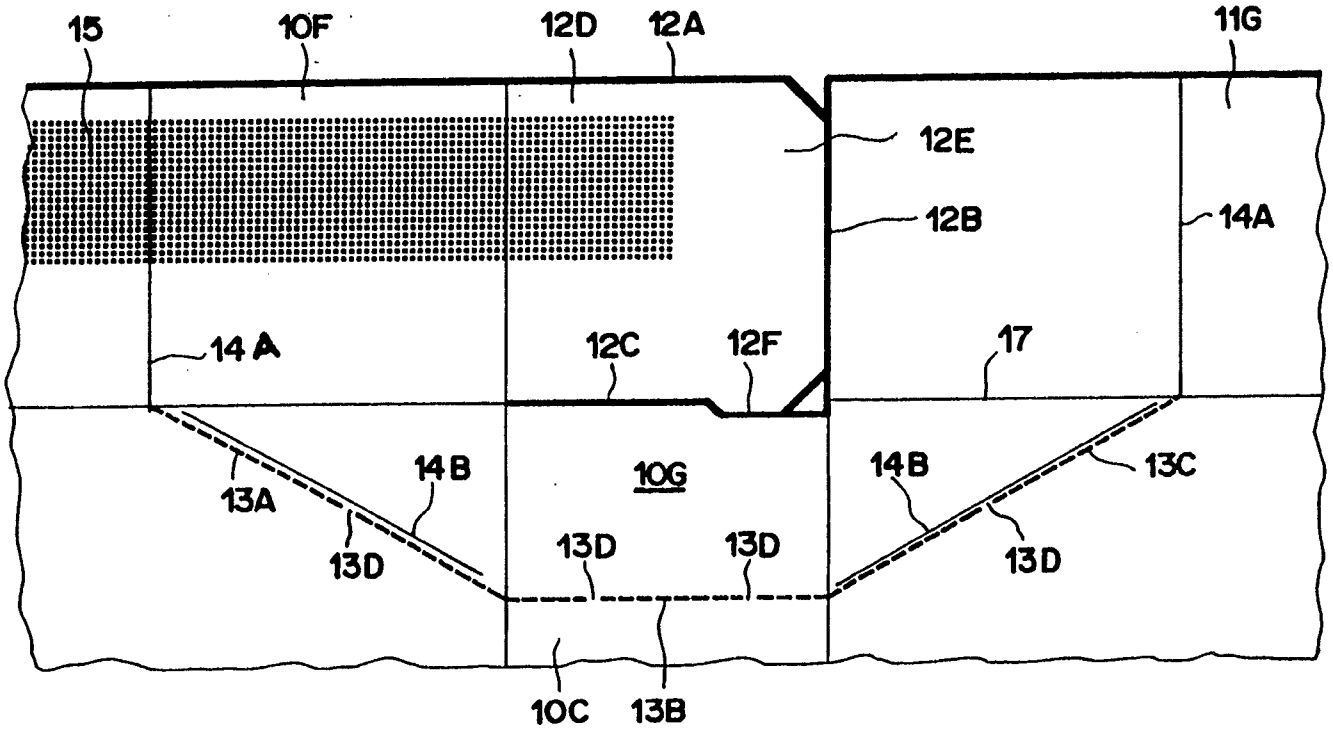
FIG. 1B is an enlarged top plan view on a larger scale of part of a blank similar to the blank of FIG. 1A, but with three modifications.

FIG. 1B shows three possible modifications of blank 1. These three modifications are independent of one another, and one or more of them may be provided on blank 1. First of all, cut line 12C may include a jog 12F causing the end portion 12E of closure flap 12 to be slightly wider. Thus, when this end portion is inserted into the erected pack to reclose it, as will be explained below, jog 12F will aid in keeping the pack closed. It will further be noted that in FIG. 1B, perforation lines 13A, 13B, and 13C are different from those described above in that they are incomplete. Each incomplete perforation line 13A, 13B, 13C leaves one or more tear tabs 13D to be torn when the pack is first opened. Finally, one or more reinforcing grooves or ribs 14B may be disposed parallel to one another and to oblique perforation line 13A. A similar set of one or more reinforcing grooves or ribs 14B may be disposed parallel to perforated line 13C. Reinforcing grooves or ribs 14B reinforce the two side faces of the opening and closing part of the box. Reinforcing grooves or ribs 14B are preferably made at the same time and in the same way as fold ribs 14A. Through the presence of reinforcing grooves or ribs 14B, the lid of the box preferably becomes more rigid and thus preferably retains its shape even after the box has been opened and closed numerous times.

Figure 2:
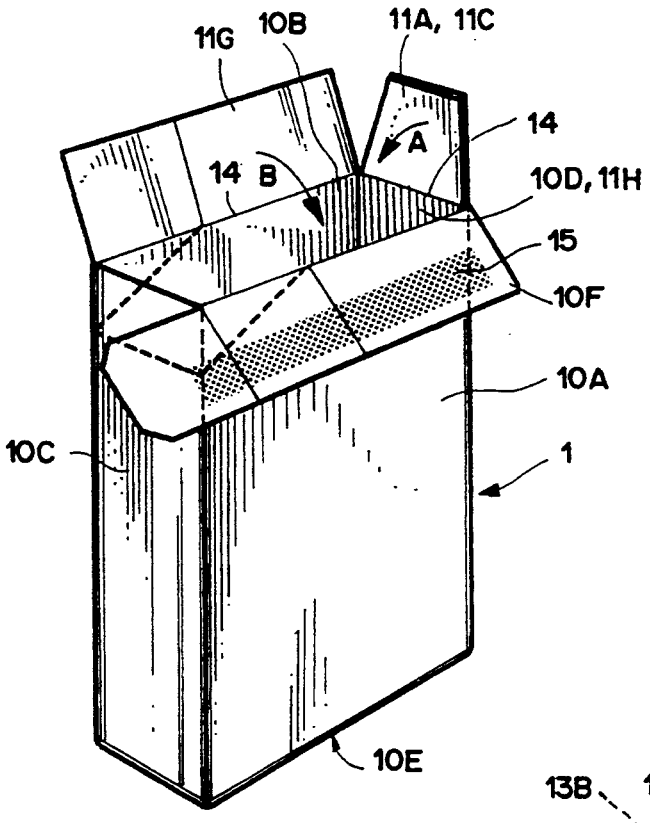
FIG. 2 is a perspective view of the blank of FIG. 1A in the process of being erected.

FIG. 2 shows diagrammatically a cigarette box in the course of being erected from blank 1. The parts of blank 1 forming front wall 10A, rear wall 10B, side walls 10C and 10D, and bottom 10E have already been folded and erected in a conventional manner. In the step shown in FIG. 2, flap 11G is preferably folded down over flap 11A in the directions indicated by arrows A, B.

Figure 3:
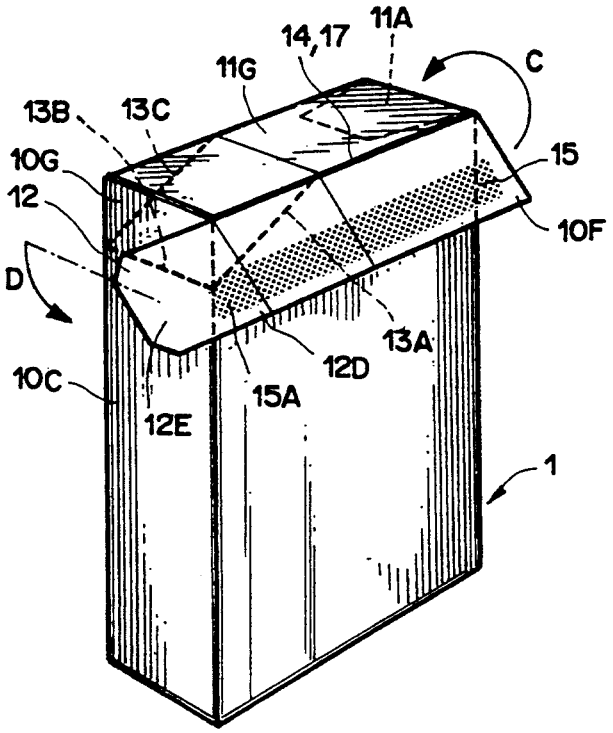
FIG. 3 is a perspective view of the blank of FIG. 1A during a subsequent erecting operation.

The last step in assembling the pack is shown in FIG. 3. Top 10F is preferably first folded down over flap 11G in the direction indicated by arrow C, and is preferably held there by adhesive 15. Then closure flap 12 is preferably folded down over top portion 10G of side wall 10C of the box, in the direction shown by arrow D, preferably being held there by adhesive 15A on rear part 12D of closure flap 12. Front part 12E, free of adhesive, is preferably superimposed on wall 10C below perforation line 13B.

FIG. 3 illustrates, in a preferred embodiment of the inventive method, the sequence of steps for folding the various walls of the box. It is equally possible to produce the box by first folding part 10F, to which closure flap 12 is attached, over flap or flaps 11A and 11C, then folding down closure flap 12 in the same way as described above, and finally folding down flap 11G, which then forms the top of the pack. Adhesive zones 15 must then be adapted as a function of this type of folding.

It will be appreciated that the erecting operations described here preferably take place in an automatic machine, at the same time as the filling of the pack, and that FIGS. 2 and 3 serve merely to illustrate the steps of assembly.

The finished pack is shown in FIG. 4, where closure flap 12 is seen to be preferably formed in one piece, as a direct continuation of top 10F of the box. Since this one piece is adhesively attached directly to the inside flaps, and since perforation lines 13A, 13B, and 13C are still unbroken, the part of the box forming lid 16 is intrinsically joined to the rest of the packaging box. The pack of cigarettes is therefore fluid-tight and can thus be stored and sold as is, without its being necessary to cover it with an additional protective sheet as well.

Front part 12E of closure flap 12 is superimposed on side wall 10C of the pack, and can thus be easily grasped by the user. Because rear part 12D thereof is adhesively fixed to the top part 10G of side wall 10C, the user can pull along the whole upper side portion functioning as lid 16 by ripping open the tear started by the three perforation lines 13A, 13B, and 13C. Lid 16 hinges about fold line 14 or optional fold rib 14A in order to reveal the contents of the pack, as shown in FIG. 5.

After extraction of a cigarette, the pack can be reclosed by inserting end 12E of closure flap 12 inside the pack behind the edge formed by what remains of perforation line 13B, as shown in FIG. 6. Thus, it is possible to reclose the pack, which is kept shut by end 12E of closure flap 12.

Blank 1, as described above, as well as the box it constitutes after being erected, represents a preferred embodiment of the invention, but other embodiments can be envisaged. Although a preferred way of cutting out blank 1 is illustrated in FIG. 1A, other ways of cutting the blank, permitting the erection of a box having the same characteristics as described, are also possible. Likewise, although the part of the packaging box forming lid 16 has been described as preferably being disposed on an upper side portion of the box, it is also possible to dispose it in a position rotated by 90 about a vertical axis, i.e., the opening would then not be at the side of the pack but at the front, for example. Generally speaking, the walls of the box which have been described as being the front wall or the rear wall would then become side walls.

The box has been described as preferably having free end 12E of closure flap 12 disposed over the top part of wall 10C at the time of manufacture. In an alternative embodiment, when the box is being erected, this flap end can remain inside the pack. This has the advantage of yielding a box of which no wall has a partially thickened portion, thus contributing toward the attractiveness of the pack. It will be understood that such a box will not be opened as easily as the first preferred embodiment. However, it will have the other advantages of the invention.

It has been stated that blank 1 is preferably made of a sheet of thin cardboard, preferably cardboard which is recycled or is easy to recycle. This sheet may be laminated on one or both sides. On the other hand, it may be made up from a thin sheet of synthetic material, or possibly from a thin sheet of cardboard covered on both sides with a synthetic coating. The synthetic material or coating may be capable of being sealed by the application of heat or pressure. For purposes of this description and the claims that follow, such a material or coating will be described as "self-sealing." If a self-sealing material or coating is used, it may not be necessary to provide adhesive zones on the blank. Instead the erected box can be heated to a predetermined temperature in the areas to be adhered, for example, so that the surfaces in contact adhere to one another. In this way, substantially absolute fluid-tightness of the pack can be ensured. Of course, other types of materials that allow the erected box to be sealed without adhesive may also be used.

One skilled in the art will appreciate that the present invention can be practiced by other than the described embodiments, which are presented for purposes of illustration and not of limitation, and the present invention is limited only by the claims which follow.

What is claimed is:

1. A packaging box, especially for products of the tobacco industry, made from a one-piece blank, said packaging box comprising:

a first wall including a first perforation line;

second and third walls adjacent to said first wall and respectively including second and third perforation lines;

a top wall including a transverse fold line meeting said second and third perforation lines;

a lid portion including an upper part of said first side wall and of upper side portions of said second and third side walls and bounded by said perforation lines and said transverse fold line; and a closure flap adjoining said top wall and including a portion formed to said lid portion as a continuation thereof via a second fold line, said closure flap further comprising a free end portion extending from said portion.

2. The packaging box of claim 1, further comprising a fold rib at the location of said fold line.

3. The packaging box of claim 1, wherein said closure flap includes a jog at the free end portion thereof, said log widening the free end portion to retain the closure flap in a closed position when inserted into a lower part of said first wall.

4. The packaging box of claim 1, wherein each of said second and third walls includes at least one reinforcing rib on said lid portion adjacent to a respective one of said second and third perforation lines and parallel thereto.

5. The packaging box of claim 1, wherein said closure flap is superimposed over the upper part of said first wall.

6. The packaging box according to claim 5, wherein said free portion extends past the first perforation line.

7. The packaging box of claim 1, further comprising a fourth wall adjacent said second and third walls and opposite said first wall, and a bottom wall adjacent said side walls and opposite said top face, wherein said walls are joined to adjacent walls by respective fold lines.

8. The packaging box of claim 7, wherein at least one side of said walls, said lid portion, said closure flap, and said lines are laminated.

9. The packaging box of claim 7, wherein both sides of said walls, said lid portion, said closure flap and said lines are laminated.

10. The packaging box of claim 1, wherein at least one side of said walls, said lid portion, said closure flap, and said lines are laminated.

11. The packaging box of claim 1, wherein both sides of said walls, said lid portion, said closure flap and said lines are laminated.

12. The packaging box of claim 1, further comprising means for retaining said free end portion when said free end portion is inserted into a lower part of said first wall.

13. The packaging box of claim 1, wherein said first, second and third perforation lines are cut partially through said respective first, second and third walls.

14. The packaging box of claim 7, further comprising means for retaining said free end portion when said free end portion is inserted into a lower part of said first wall.

15. The packaging box of claim 7, wherein said first, second and third perforation lines are cut partially through said respective first, second and third walls.

16. A one-piece blank for producing a packaging box, especially for products of the tobacco industry, said blank having a plurality of surface portions intended to form walls and flaps of said box and a plurality of fold lines interconnecting said surface portions, said blank further comprising:

a closure flap connected by one of said fold lines to one of said surface portions intended to form a top wall of said box;

a respective perforation line cut into each of three respective said surface portions; and at least one attachment zone; wherein:

a first one of said perforation lines is disposed across a top part of one of said surface portions intended to form a first side wall closest to said closure flap, and the other two perforation lines being disposed symmetrically, each on one of said surface portions intended to form a second side wall and a third side wall, respectively;

each of said second side wall and said third side wall, respectively, is adjacent to said first side wall, one of each of said two perforation lines joining a respective end of said first perforation line, an opposite end of each of said two perforation lines being situated on one of said folding lines defining the top edges of said surface portions forming said second side wall and said third side wall, respectively;

the length of said closure flap is greater than the distance separating said first perforation line from a top edge of said first side wall on which said first perforation line is disposed; and said attachment zone is intended for attaching said one of said surface portions situated between said first perforation line and said top edge of said first side wall to a surface portion of said closure flap intended to be superimposed thereon.

17. The blank of claim 16, wherein said perforation lines are cut partially through the thickness of said blank.

18. The blank of claim 16, wherein said perforation lines are partially cut along their length, leaving at least one tear tab.

19. The blank of claim 16, further comprising at least one reinforcement rib respectively disposed on each of said second and third walls, between the top edge thereof and said respective one of said other two perforation lines, and parallel to said one of said other two perforation lines.

20. The blank of claim 16 made of a sheet of thin cardboard, wherein said attachment zone is an adhesive zone.

21. The blank of claim 16 made of a sheet of self-sealing material, said attachment zone being a zone to be attached self-sealingly.

22. The blank of claim 16 coated with at least one layer of self-sealing material, said attachment zone being a zone to be attached self-sealingly.

23. The blank of claim 16 made of a sheet laminated on one side.

24. The blank of claim 16 made of a sheet laminated on both sides.

25. The blank of claim 17 made of a sheet laminated on one side.

26. The blank of claim 17 made of a sheet laminated on both sides.

27. The blank of claim 16, wherein said closure flap further comprises a jog widening said closure flap at an end opposite said fold line connecting said closure flap to one of said surface portions intended to form a top wall of said box.

28. A packaging box, especially for products of the tobacco industry, made from a one-piece blank, said packaging box comprising:

a first wall including a first perforation line;

second and third walls adjacent to said first wall and respectively including second and third perforation lines;

a top face including a transverse fold line meeting said second and third perforation lines;

a lid portion including an upper part of said first side wall and of upper side portions of said second and third side walls and bounded by said perforation lines and said fold line; and a closure flap adjoining said top face and including a free portion and a portion attached to said lid portion;

wherein each of said second and third walls includes at least one reinforcing rib on said lid portion adjacent to a respective one of said second and third perforation lines and parallel thereto.

29. The packaging box of claim 28, further comprising a fold rib at the location of said fold line.

30. The packaging box of claim 28, wherein said closure flap includes a jog at the free portion thereof, said jog widening the free position to retain the closure flap in a closed position when inserted into a lower part of said first wall.

31. The packaging box of claim 28, said closure flap is formed as a continuation of said lid portion via a second fold line.

32. The packaging box according to claim 28, wherein said free portion extends past the first perforation line.

33. The packaging box of claim 28, wherein said closure flap overlies the upper part of said first wall.

34. The packaging box of claim 28, wherein at least one side of said walls, said lid portion, said closure flap, and said lines are laminated.

35. The packaging box of claim 28, wherein both sides of said walls, said lid portion, said closure flap and said lines are laminated.

36. The packaging box of claim 28, further comprising means for retaining said free end portion when said free end portion is inserted into a lower part of said first wall.

37. The packaging box of claim 28, wherein said first, second and third perforation lines are cut partially through said respective first, second and third walls.

* * * * *